United States Patent [19]

Patterson

[11] 4,148,302

[45] Apr. 10, 1979

[54] THERMAL FLUE APPARATUS

[76] Inventor: Tommy W. Patterson, P.O. Box 25, Hayesville, Ohio 44838

[21] Appl. No.: 812,749

[22] Filed: Jul. 5, 1977

[51] Int. Cl.[2] ..... F23J 11/00

[52] U.S. Cl. ..... 126/307 R; 126/201

[58] Field of Search ..... 126/307 R, 307 A, 290, 126/202, 67, 201, 203; 237/79

[56] References Cited

U.S. PATENT DOCUMENTS

| | | | |
|---|---|---|---|
| 89,181 | 4/1869 | Stoddard, et al. | 237/79 X |
| 400,689 | 4/1889 | Keyser | 126/140 X |
| 415,706 | 11/1889 | Drake | 126/307 A X |
| 483,187 | 9/1892 | Turner | 126/67 |
| 559,083 | 4/1896 | Pierce | 327/79 X |
| 566,149 | 8/1896 | Donaldson | 126/202 X |
| 1,094,066 | 4/1914 | Gier | 126/201 |
| 1,615,909 | 2/1927 | Nance | 126/307 R |
| 2,075,210 | 4/1937 | Stadtfeld | 126/307 R X |
| 2,591,235 | 4/1952 | Cartter | 126/307 R X |
| 2,629,370 | 2/1953 | Janski | 126/201 |
| 2,903,956 | 9/1959 | Schroeder | 126/307 A X |
| 3,171,402 | 3/1965 | Carlson | 126/307 R X |

FOREIGN PATENT DOCUMENTS

| | | | |
|---|---|---|---|
| 494957 | 8/1953 | Canada | 126/307 |

*Primary Examiner*—Dennis L. Taylor

*Attorney, Agent, or Firm*—Oldham, Oldham, Hudak & Weber

[57] ABSTRACT

A thermal shield device is provided for association with a flue extending from a combustion chamber and which shield device comprises a substantially U-shaped member comprising radially spaced inner and outer walls and with the shield being positioned parallel to the vertically extending flue and covering approximately 180° of the periphery thereof, normally between the flue and an adjacent wall, the flue being open ended and having a deflector collar or neck positioned at its upper end connecting to the open or hollow interior thereof for deflection of hot air rising through the shield out into the room, and with other deflector members being positioned intermediate the inner wall of the shield and the adjacent flue to deflect hot air rising along the flue periphery out into the room.

7 Claims, 4 Drawing Figures

THERMAL FLUE APPARATUS

BACKGROUND OF INVENTION

At the present time, more and more stoves are being positioned in rooms for heating the room and/or the room plus adjacent areas. These stoves have proven to be desirable, practical means for heating small homes, mobile homes and other structures. However, in providing a small furnace or stove in a room, naturally, there are problems in exhausting the hot combustion gases from the room and many fires have been started in the past because of these stoves and the flues therefor becoming overheated.

Furthermore, with the energy situation of current times, it is very desirable that efficient, effective heating systems be provided for all homes and buildings.

Accordingly, it is the general object of the present invention to provide a new and improved heat deflector apparatus or thermal flue apparatus for association with combustion chamber flues for withdrawing more heat efficiently from the hot flue gases and deflecting or circulating such heat into the adjacent atmosphere.

Another object of the invention is to provide a heat shield in association with a vertically extending flue for aiding in preventing radiation or flow of heat from the flue into any adjacent wall structures and aiding in preventing overheating of walls or ceilings connecting to or adjacent the flues.

Another object of the invention is to provide a relatively inexpensive but durable metal heat shield for association with vertically extending flues to withdraw heat therefrom and to aid in heating and circulating heated aid in the atmosphere adjacent to the combustion chamber and stove in which it is positioned.

Other objects and advantages of the invention will be made more apparent as the specification proceeds.

Reference now is particularly made to the accompanying drawings wherein.

When referring to corresponding members shown in the drawings and referred to in the specification, corresponding numerals are used to facilitate comparison therebetween.

SUBJECT MATTER OF THE INVENTION

This invention, as one embodiment thereof, relates to a heat deflector and/or safety device for use in combination with a vertically positioned flue having hot combustion gases passing therethrough and where the safety device comprises a double walled shield of substantially U-shape in section, the shield having open upper and lower ends and encompassing over 180° of the periphery of the flue when associated therewith, which shield has spaced inner and outer walls. Means secure the shield to the flue in spaced relation thereto and an open front of the shield faces toward the center of the room, a conically shaped collar member extends from the inner wall of the shield upwardly to the flue to divert air flowing upwardly between the shield and flue out into the room, and a conical neck section connects to the interior of the shield at an open upper end thereof and it extends to the flue, such neck section having an open front portion for discharging heated air passing upwardly within the shield out into the room.

Figure 1:
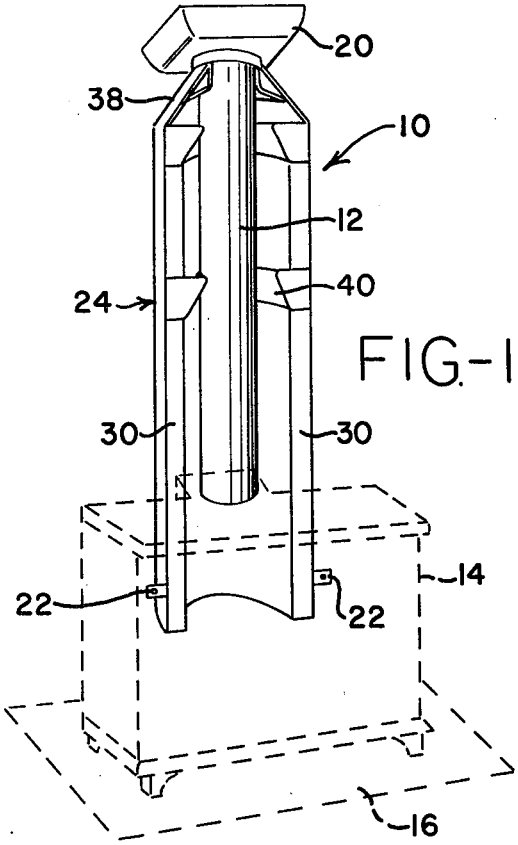
FIG. 1 is a front elevation of a heat deflector shield of the invention shown in connection with a flue connecting to a stove as shown in dotted lines in the drawing.

Reference now is made to the details of the structure shown in the drawings, and FIG. 1 indicates a heat deflector and safety device 10 of the invention positioned in association with a vertically extending flue 12. This flue 12 connects to any conventional or known furnace or combustion chamber or stove indicated at 14. The stove may be positioned on a support or floor 16 within a room having an enclosure wall 18 indicated for the room 17. The flue 12 extends up to a ceiling or roof for the room 17 and engages a suitable connector means or fire resistant structure 20 at such ceiling.

Figure 2:
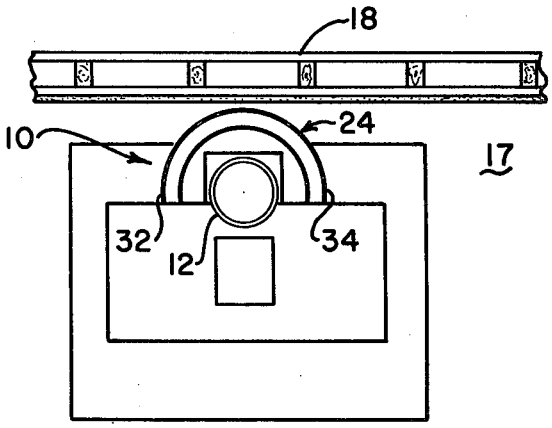
FIG. 2 is a plan view, partially diagrammatic, of the flue and stove construction of FIG. 1 positioned in a room adjacent a wall thereof.

FIG. 2 of the drawings shows that the flue 12 usually is positioned closely adjacent to the wall 18 and it is well known that these flues 12, having hot combustion gases passing therethrough, present a fire hazard. But many of these stoves are used for heating one or more rooms and the hot gases must be safely vented.

The heat deflector and safety device 10 can be secured in position adjacent to or supported on the stove 14, or from the building wall by any conventional means. Brackets or flange plates 22 are shown at the lower end of the device 10 to be used for securing the safety device to the stove in operative association with the flue. Such safety device extends vertically and it is normally positioned in parallel but spaced relation to the flue 12.

Figure 3:
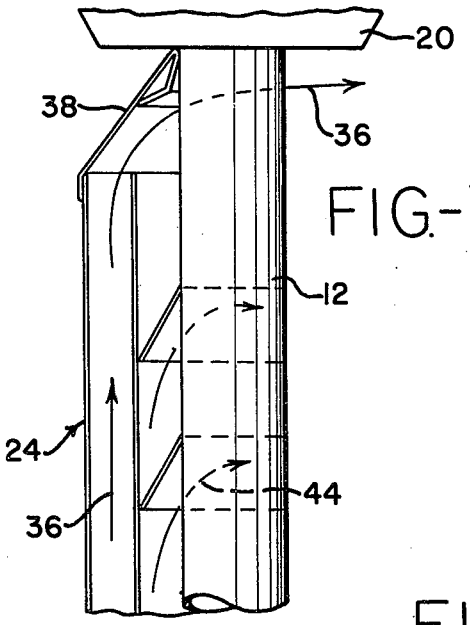
FIG. 3 is a fragmentary vertical section through a portion of the heat deflector shield of FIG. 1 and associated flue means and indicating air flow patterns.
Figure 4:
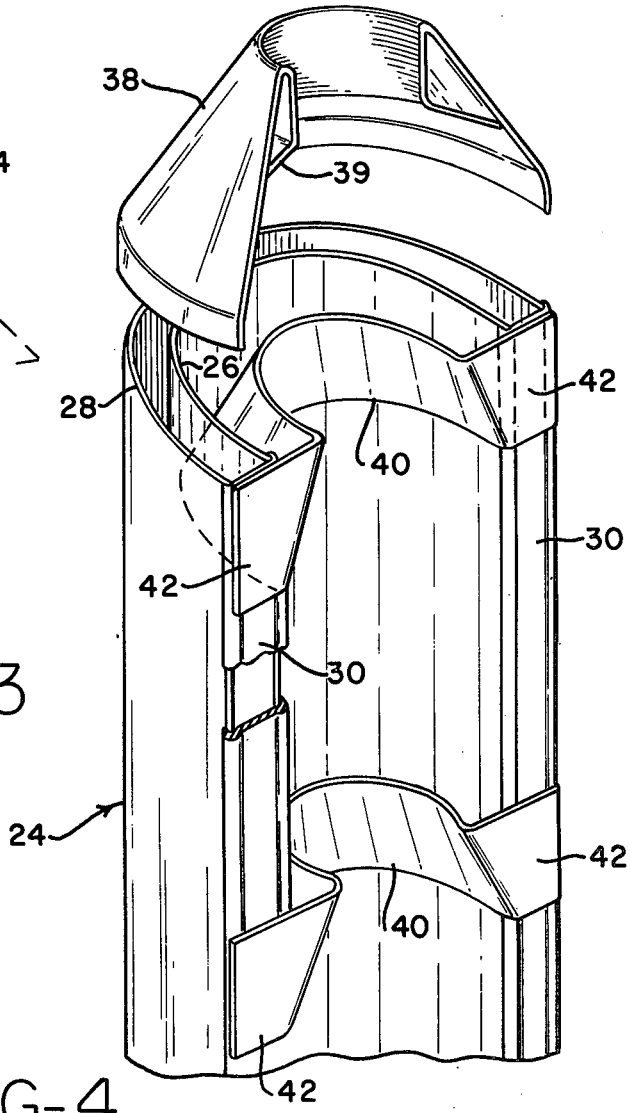
FIG. 4 is a perspective view of the heat deflector shield of the invention and the collar means therof with parts broken away to show more details of the constructions of the shield.

This heat deflector and safety device 10 includes a heat shield indicated at 24 and which heat shield has open lower and upper ends and is formed from substantially parallel or concentric inner and outer walls 26 and 28, respectively, and with such heat shield being of substantially U-shape in horizontal section. Any suitable members, such as channels 30, can be engaged with the front ends of this heat shield at the inner and outer walls thereof to form an enclosed passageway extending the length of the shield. The heat shield is of such an arcuate length that it does encompass over 180° of the periphery of the flue 12, as indicated best in FIG. 2. Usually the heat shield 24 has an open front facing into the room 17 in which the stove is positioned, and this heat shield may terminate in diametrically opposed parallel side portions 32 and 24 as indicated in the drawings. Hence, the heat shield is adapted to provide a vertical passageway for air moving from a point adjacent the stove upwardly in the room and such air flow path through the shield is indicated by arrows 36 in FIG. 3. To deflect such rising heated air away from the heat shield, preferably at the upper end thereof, there is a conical connector member 38 that engages the outer wall of the open upper end of the shield. The connector 38 preferably has a generally inwardly sloping upper inner wall portion 39 that extends to and engages the flue 12 and may also engage the ceiling connector plate or bracket 20. The arrows 36 show how air is deflected out into the room by the connector 38 that is of approximately 180° in arcuate extent. This connector 38 is omitted for clarity in FIG. 2.

It also should be realized that an appreciable amount of heat is being radiated from the flue 12 for the length thereof and it is heating the air adjacent thereto. To benefit from such heating action and to aid in air circulation in the room, one or more vertically spaced, conically shaped collar members 40 are provided. Two of these members are shown in the drawings and are positioned in vertically spaced relationship to each other. The conical shaped collar members 40 are of a size so as to extend from the inner wall 26 of the heat shield up to and engage the flue 12 but with the collars being provided with open fronts. Thus, the collars force or deflect air flowing upwardly along the flue out into the room through the open front of the heat shield. These collars 40 preferably have end flanges 42 thereon that are secured, as by welding or other equivalent means, to the front edge channels 30 of the heat shield 24 to retain them in desired positions. Arrows 44 indicate air flow path provided by these deflector collars. Again, means are provided for aiding in the circulation of air heated by the flue 12. Thus, such circulation of air around the flue and deflecting it out into the room materially increases the efficiency of the heating action of the stove 14. Furthermore, the heat shield 24 as a whole does provide a very effective safety device for use in association with the stove 14 and flue 12.

The components of the heat deflector and safety device are all made from suitable metal and they can be assembled together in any conventional manner and provided with any desired finish or have a natural metallic finish provided thereon, as desired. The neck or conical connector 38 can be welded or just physically engaged with the upper end of the heat shield, as desired.

The components of the invention are relatively durable and can be made from conventional gage metal sheets or plates. The unit will function effectively and provide a good service life. Thus, it is believed that the objects of the invention have been achieved.

While one complete embodiment of the invention has been disclosed herein, it will be appreciated that modification of this particular embodiment of the invention may be resorted to without departing from the scope of the invention.

What is claimed is:

1. A heat deflector and safety device for use in combination with a vertically positioned flue positioned in a room and connecting to a combustion chamber and comprising a double walled shield of substantially U-shape in section, which shield has open upper and lower ends and which encompasses over 180° of the periphery of an associated flue, said shield having spaced inner and outer walls, means securing said shield to said flue but spaced therefrom and with an open front of said shield facing towards the center of the room, a conically shaped collar member connecting to the inner wall of said shield and extending upwardly to said flue to divert air flowing upwardly between said shield and said flue out into the room, and a conical neck section having an open front connecting the interior of said shield at its upper end to the outer surface of said flue, which neck section has a front portion that is open to the room to discharge heated air thereto.

2. A heat deflector and safety device as in claim 1, where a plurality of vertically spaced collar members are present.

3. A heat deflector and safety device as in claim 1, where said shield forms a vertically extending enclosure and said shield has opposed parallel front end portions.

4. In combination in a room having a stove therein, a vertically positioned flue connecting to the stove and receiving hot combustion gases therefrom, said flue extending to the ceiling or roof of the room, and a heat shield having open ends positioned around part of and extending a major portion of the length of the flue, said heat shield being an enclosure of semi-cylindrical shape in horizontal section and including spaced inner and outer walls, such inner wall being spaced radially from said flue, deflector means having lower surfaces of conical shape converging upwardly and inwardly towards said flue and extending between said inner wall and flue to deflect hot air rising along said flue into the room, and a top connector member engaging the open upper end of said heat shield and extending to said flue to deflect hot gases rising within said heat shield out into said room.

5. A combination as in claim 4, wherein both said deflector means and connector member extend around only part of the flue.

6. A combination as in claim 4, where said heat shield is of substantially U-shape in section and it encompasses about 180° of the periphery of the flue, and said deflector members have open front areas for air flow from under such deflector members out into the room.

7. A combination as in claim 4 where said connector member has an open front and is of roughly conical shape in vertical section, said connector member engaging only the outer wall of the heat shield to deflect hot gases from its open front out into the room.

* * * * *